United States Patent [19]

Fletcher

[11] 4,283,198

[45] Aug. 11, 1981

[54] INERT ATMOSPHERE INDIGO DYEING

[76] Inventor: John M. Fletcher, Rte. 3, Box 376, Opelika, Ala. 36801

[21] Appl. No.: 111,337

[22] Filed: Jan. 11, 1980

[51] Int. Cl.[3] ..... C09B 7/00

[52] U.S. Cl. ..... 8/653; 8/148; 8/918

[58] Field of Search ..... 8/38, 34, 35, 653, 918, 8/148

[56] References Cited

U.S. PATENT DOCUMENTS

| | | | |
|---|---|---|---|
| 678 | 4/1838 | Woodcroft | 8/70 |
| 2,920,932 | 1/1960 | Barnhill | 8/38 |
| 4,082,502 | 4/1978 | von der Eltz | 8/34 |

*Primary Examiner*—A. Lionel Clingman

*Attorney, Agent, or Firm*—Dean R. Rexford

[57] ABSTRACT

Oxidation in a leuco indigo dyebath is decreased by enclosing the air-liquor interface whereby enclosed air is depleted of oxygen by the dyebath components.

5 Claims, 1 Drawing Figure

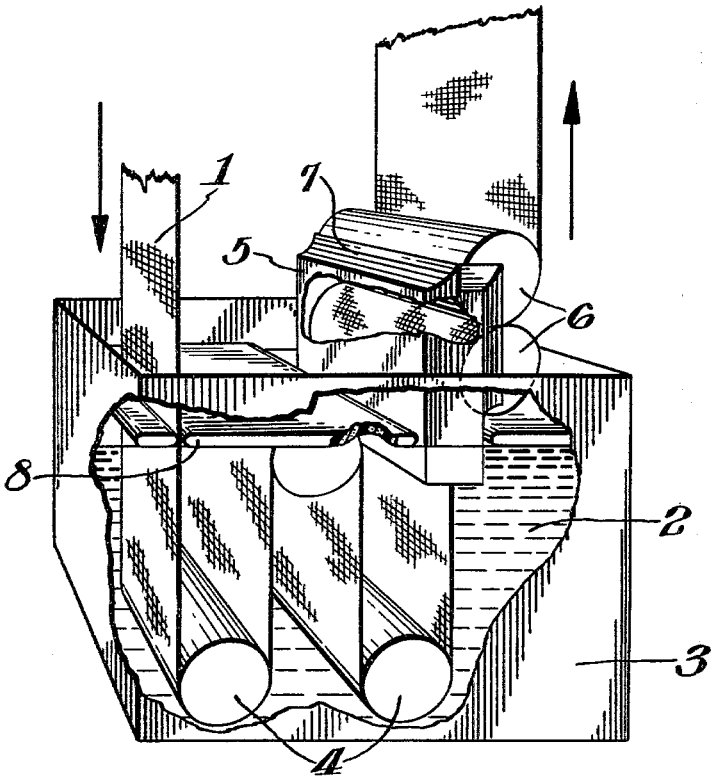
1
7
5
6
8
2
3
4

INERT ATMOSPHERE INDIGO DYEING

FIELD OF THE INVENTION

This invention pertains to the dyeing of cotton and other cellulosic fibers with indigo in leuco dyebaths comprising sodium hydrosulfite ($Na_2S_2O_4$) and sodium hydroxide (NaOH).

BACKGROUND OF THE INVENTION AND PRIOR ART

Commercial vat dyeing is usually carried out in an aqueous alkaline bath in which the reduced form of the dye, the so-called leuco form, is dissolved. Fibers in the form of fabric, or warp yarns, are passed through the bath with a residence time such as to permit the fibers to absorb the desired amount of leuco dye. The fibers are then removed from the bath and exposed to air which oxidizes the dye to the insoluble form. Because leuco indigo, unlike most other vat dyes, has only limited affinity for cellulose, dyeing is especially difficult. In order to obtain adequate depth of shade, corresponding, for example, to 1.6 wt. % fixed indigo, it is trade practice to pass the fibers through a train of four to six dip vats containing bath liquor comprising leuco indigo, sodium hydrosulfite reductant and sodium hydroxide. Following each dip, the fibers are squeezed between rolls, thus reducing the bath liquor pickup to about 65% on the weight of the fiber. Thereafter, the fibers are carried over rolls in the open air, called a greening passage, a process also known as "skying," where the leuco indigo is oxidized to the insoluble form thus fixing it in the fibers. The residence time of the fibers in and the temperature of the dip vats are selected to allow soluble leuco indigo to penetrate the fibers yet not reconvert substantial amounts of indigo already fixed to the soluble leuco form. Typically ambient temperature and temperatures as high as 35° C. are employed. A dip bath residence time of 60 seconds is typical. On leaving the dyeing train, the fibers are scoured and dried.

Oxidation in the dip baths of the vat dye liquor, which, of course, is undesirable, is troublesome in all vat dyeing but is particularly so in indigo dyeing. Oxidation occurs where the liquor contacts the air for example at the horizontal air-liquor interface, and especially in the region of the squeeze rolls where multiple interfaces are generated exposing large areas of liquor to the air through draining of expressed liquor and splashing.

This unwanted oxidation results in significant loss of expensive sodium hydrosulfite and sodium hydroxide and the formation of troublesome floating scum of reoxidized insoluable dye which often cause spotting and uneven dyeing.

It has long been recognized that substitution of an inert gas for oxygen-containing air contacting the indigo dyebath would avoid the above problem. Already in 1838 Woodcroft suggested in U.S. Pat. No. 678 the use of air from which the oxygen has been depleted by contacting with sulfuret of lime. It was suggested to print cotton fabric with leuco indigo in a chamber containing air from which the oxygen has been removed in the above manner. An operator inside the chamber was to be provided with an enclosing impervious suit fitted with hoses for providing breathing air from outside the chamber. The system has not been adopted in the trade.

SUMMARY OF THE INVENTION

In the continuous process of dyeing with indigo wherein cellulosic fibers are passed through a train of dip vats containing leuco indigo, sodium hydrosulfite and sodium hydroxide bath liquor, oxidation in the dip vats is decreased by enclosing the air-liquor interface whereby enclosed air is depleted of oxygen by reaction with the components of the bath liquor.

BRIEF DESCRIPTION OF THE DRAWING

The drawing shows in perspective a single dip vat and squeeze roll assembly of an art indigo dyeing train, having invention enclosures enclosing the squeeze roll assembly and the horizontal air-liquor interface.

DETAILED DESCRIPTION OF THE PREFERRED EMBODIMENTS

This invention pertains to an improvement in the continuous dyeing with indigo of cellulosic fibers such as cotton and rayon, usually in the form of fabric or warp yarns, optionally in mixture with other fibers. The invention improvement, which results is substantial reduction of oxidation in the dip vat of the components of the leuco indigo bath, stems from my discovery that enclosure of the air-liquor interface of a leuco indigo bath comprising sodium hydrosulfite and sodium hydroxide results in consumption of enclosed atmospheric oxygen at the enclosed interface though oxidation of some of the bath liquor components in the early stages of a continuous dyeing run thus decreasing oxidation during the remainder of the run. The depletion process consuming oxygen appears to proceed more or less according to the following equation:

$$\underset{\text{Sodium hydrosulfite}}{Na_2S_2O_4} + \underset{\text{sodium hydroxide}}{2\,NaOH} + \underset{\text{oxygen}}{O_2} \longrightarrow H_2O + \underset{\text{sodium sulfite}}{Na_2SO_3}$$

As the equation shows, there is a net reduction in the volume of gas within the enclosure as the oxygen is consumed. However, because the enclosure is necessarily not entirely gas tight some additional air is drawn into the enclosure during the early stages of a dyeing run so that the pressure remains approximately atmospheric. The composition of the gas within the enclosure, during an extended dyeing run, approaches a composition consisting essentially of nitrogen, the rare atmospheric gases and small amounts of sulfur dioxide in equilibrium as is known, with the sodium sulfite and hydrosulfite of the bath.

The principal advantages of this invention are realized by enclosing the multiple interfaces in the region of the squeeze rolls. In a preferred embodiment, however, I also reduce losses to oxidation at the horizontal air-liquor interface by enclosing it by floating on it easily inserted and removed foamed plastic planks such as foamed polystyrene. Small amounts of air carried into the bath by the fibres accumulates in part as bubbles under the planks where contained oxygen is consumed. The planks do not greatly interfere with make up of the bath or with threading the fibers into the device.

DETAILED DESCRIPTION OF THE DRAWING

The drawing shows a single dip vat and squeeze roll assembly in a preferred embodiment of the invention wherein the squeeze rolls, one above the other, and the surrounding region are enclosed and the horizontal liquor-air interface is enclosed and protected with floating foamed plastic planks.

In this embodiment cotton fabric 1 enters leuco indigo bath 2 contained is housing 3 and passes over guide rolls 4. As is known in the art the travel distance under the surface of the dyebath is selected to give optimum uptake of leuco indigo. After passing under the last of rolls 4 the fabric passes upward out of the bath into invention enclosure 5 and between squeeze rolls 6. Enclosure 5, which can be constructed from any reasonably gas tight material such as metal or plastic, is fitted with rubber flaps 7 which make contact with the ends of both rolls, the near side of the upper roll, and the bottom edge of the lower roll (not shown) so as more or less to close the space between the enclosure and the rolls.

Enclosure 5 is preferably constructed so as to permit easy threading of the device. For example, the upstream vertical wall of the enclosure can be made removable by means not shown.

To protect the horizontal air-liquor interface I prefer to employ floating planks of foamed polystyrene 8 of dimensions selected to permit fabric 1 to enter the bath without touching the planks and to cover loosely the rest of the horizontal interface of the bath. The planks 8 may be of any convenient thickness so long as they have sufficient strength that they can be easily placed on the bath and removed therefrom. The enclosed gases e.g. inside enclosure 5, as pointed out supra, will approach a composition consisting essentially of nitrogen, the rare atmospheric gases and small amounts of sulfur dioxide. Another embodiment employs squeeze rolls placed side by side with enclosure 5 and rubber flaps 7 adapted to enclose the space about the rolls, in a manner which will be apparant to the engineer.

After passing through squeeze rolls 6 the fabric 1 passes upward to the "skying" step not shown.

I claim:

1. In the continuous process of dyeing cellulosic fibers with indigo wherein said fibers are passed through a train of dip vats each having a squeeze roll assembly and bath liquor comprising leuco indigo, sodium hydrosulfite and sodium hydroxide, the improvement wherein at least a part of the air-liquor interface is enclosed whereby enclosed air is depleted of oxygen by reaction with the components of the bath liquor.

2. The process of claim 1 wherein the region of the squeeze rolls is enclosed.

3. The process of claim 1 wherein the region of the squeeze rolls and the horizontal air-liquor interface is enclosed.

4. The process of claim 3 wherein the horizontal air-liquor interface is enclosed by floating foamed plastic on said interface.

5. The process of claim 4 wherein the horizontal air-liquor interface is enclosed by floating foamed polystrene on said interface.

* * * * *